United States Patent [19]

Stubbmann

[11] Patent Number: 4,522,604

[45] Date of Patent: Jun. 11, 1985

[54] ROCKABLE TOY WITH A REFLECTING MIRROR

[75] Inventor: Albert Stubbmann, Franklin Lakes, N.J.

[73] Assignee: Shelcore, Inc., S. Plainfield, N.J.

[21] Appl. No.: 526,957

[22] Filed: Aug. 29, 1983

[51] Int. Cl.[3] ..... A63H 33/22

[52] U.S. Cl. ..... 446/219; 446/326

[58] Field of Search ..... D6/232; D21/65, 159; 350/288, 408; 446/219, 396, 326, 325, 324, 297, 397, 404, 409, 418, 419

[56] References Cited

U.S. PATENT DOCUMENTS

| | | | |
|---|---|---|---|
| 1,394,669 | 10/1921 | Da Costa | 46/155 |
| 3,729,865 | 5/1973 | Naunheim | 46/116 |
| 3,921,331 | 11/1975 | Schatz | 46/117 |

*Primary Examiner*—Mickey Yu

*Attorney, Agent, or Firm*—Stempler, Cobrin & Godsberg

[57] ABSTRACT

A rockable toy with a reflecting mirror includes a body having a bottom surface which is outwardly curved in all directions, and a center of gravity which is situated within the region bounded by the bottom wall, so that the toy will have a tendency to oscillate about a stable position in which the center of gravity is situated above the point of contact of the toy with the underlying surface. The body carries a mirror which shares in the oscillatory movement of the body when displaced out of the stable position. The body carries, outside the periphery of the mirror, a head whose reflection can be seen in the mirror by the observer, together with a background which rapidly changes during the oscillatory motion of the toy. The head is connected to the body for movement relative thereto at least in two opposite directions. The body is of a rigid synthetic plastic material, while the head is of a flexible material so that it can be squeezed. When the head is squeezed, air rushes out of it through a squeaking-sound producing device secured to the head. A chiming device is built-in into the body to produce chiming noises during the oscillatory motion of the toy.

16 Claims, 3 Drawing Figures

12
2
28
10
14
12'
15
11
13
2

10
11
12
13
16
17
18
19
20
21
22
23
24
25
27
28
29
30
31
32
34
3

ROCKABLE TOY WITH A REFLECTING MIRROR

BACKGROUND OF THE INVENTION

The present invention relates to toys in general, and more particularly to rockable toys.

There are already known many various constructions and configurations of rockable toys with many distinctive features differentiating such toys from one another. Such toys are intended, by conducting their rocking or oscillatory motion, to give an appearance of life, since life and motion are almost indistinguishable for the intended user of the toy, that is a child of tender years. For this reason, animated toys, such as the aforementioned rocking toys, have a greater appeal to such users than inanimate objects which are incapable of sustained motion once the child ceases to exert a force thereon. Of course, the appeal of the toy to the child is even more pronounced when the child is able to fully observe the motion, possibly from various angles, and when the toy is capable of performing several independent or quasi-independent motions.

Along these lines, there is already known, from the U.S. Pat. No. 2,577,343, a weighted figure toy in the shape of a seal balancing a ball on its nose. The figure is capable of performing a rocking motion in only two opposite directions, and the ball is capable of independently swinging, also in these directions, to give an appearance of a balancing act. However, the motion of all elements along a common plane lacks variety, and hence this toy soon loses its attraction in the eyes of the user.

Children of various ages also like to look into mirrors, to observe the reflections of their own faces or of objects surrounding them, or to use mirrors to throw reflected images on walls, ceilings or other surfaces or objects. Along the latter lines, there is known, from the U.S. Pat. No. 2,463,817, a toy reflector with a support therefor, wherein the support has the configuration of an airplane, and an image of a plane of opaque material is provided on a mirror so that, when light rays are reflected from the mirror, an image of the airplane appears on the surface reached by the reflected light rays. While this arrangement is capable of changing the position, angle and other attributes of the image on the surface reached by the reflected light rays, its utility is rather limited, and the various possibilities of change are quickly exhausted, so that the child quickly loses his or her interest in this toy. Moreover, this toy is so complicated and complex to handle that it can only be used by older children, which have little or no interest in the toys of this variety to begin with.

Moreover, the U.S. Pat. Nos. 3,729,865 and 3,861,078 disclose toy figures provided with mirrors at the locations of their faces, so that the child can give the toy his or her appearance by properly positioning his or her face relative to the mirror so that the reflection of such face will constitute the face of the toy. Even here, however, the novelty of the item wears off very quickly and the child's interest in the toy wanes.

Finally, U.S. Pat. No. 4,157,633 discloses a toy assembly including a toy figure and a semi-transparent mirror behind which various garments may be interchangeably placed to be visible in superimposition with the reflected image of the figure. Here again, like in the patents discussed in the previous paragraph, there is no animation, except for possible child-induced rotation of the figure, and the appeal of this toy is consequently very limited, especially to the older children for whom this toy assembly is intended.

SUMMARY OF THE INVENTION

Accordingly, it is an object of the present invention to avoid the disadvantages of the prior art.

More particularly, it is an object of the present invention to provide an animated toy which does not possess the drawback of the conventional toys of this type.

Still another object of the present invention is so to construct the toy of the type here under consideration as to be very appealing to children of tender age for whom this toy is intended, and to sustain their interest in playing with this toy.

It is yet another object to so design the toy of the above type as to give an appearance of uncontrolled motion akin, in the perception of the child, of life of its own.

A concomitant object of the present invention is to devise a toy of the above type which is simple in construction, inexpensive to manufacture, safe and easy to use, and reliable in operation nevertheless.

In pursuance of these objects and others which will become apparent hereafter, one feature of the present invention resides in a rockable or oscillatable toy which comprises, in combination, a main body having a bottom surface that is curved in all directions, the toy having a center of gravity situated substantially on a central axis of the body and within the confines of the curved bottom surface so that, when the toy is displaced in any direction from its stable position in which the central axis is substantially vertical, it will oscillate about its stable position until such oscillatory motion is damped sufficiently for the toy to remain in its stable position; and at least one mirror mounted on the main body for displacement therewith to present to the observer of the toy different and constantly changing reflected images during the oscillatory motion of the toy.

A particular advantage of the toy as described so far is that not only will the toy rock or oscillate for a long time after the child has ceased to apply any force thereto, and in all possible directions as determined by the original jolt or movement starting the oscillatory motion, but also the images reflected and thus seen by the observer in the mirror will change rapidly, apparently without any relation to the rocking motion of the toy.

According to a currently preferred aspect of the present invention, the main body has generally the appearance and configuration of a body of a figure in a sitting position. Then, the toy advantageously further comprises a head mounted on the body outside the periphery of the mirror and in the line of sight of the observer via its reflection in the mirror in the intended position of use of the toy relative to the observer, so that the reflection of the head in the mirror will appear in front of an ever-changing background during the oscillatory motion of the toy. In this respect, it is further advantageous when the head is mounted on the body for a swinging motion relative to the latter in at least two opposite directions so that, during the oscillatory motion of the toy, the swinging motion of the reflection of the head in the mirror will be superimposed on the ever-changing background. A pronounced advantage of this arrangement is that the head or the facial features thereof will always be visible to the observer in the mirror, against the backdrop of changing background and, when the head conducts movements relative to the body, such a motion will be combined with the motion of the background to give a life-like appearance. It is especially advantageous in this respect when the head is mounted on the body with freedom of movement relative thereto in a multitude of directions.

According to another advantageous aspect of the present invention, the head is of an elastic material so as to be capable of being squeezed and deformed. In this connection, it is especially advantageous when the head includes a squeaking device incorporated therein and operative for producing at least one sound in response to the deformation of the head.

Generally speaking, the toy comprises, in addition to the body which need not have the appearance of a sitting figure body, an element of distinctive features forming an extension of the body at a region situated outside the periphery of the mirror and in the line of sight of the observer via its reflection in the mirror in the intended position of use of the toy relative to the observer, so that the reflection of the distinctive features of the element in the mirror will appear in front of an ever-changing background during the oscillatory motion of the toy. Advantageously, the aforementioned element is separate from the body and is mounted on the latter for a swinging motion relative thereto at least in two opposite directions so that, during the oscillatory motion of the toy, the swinging motion of the reflection of the distinctive features of the element in the mirror will be superimposed on the ever-changing background. Advantageously, even in this instance, the element is mounted on the body with freedom of movement relative to the body in a multitude of directions which are not necessarily opposite to one another.

To achieve the positioning of the head or element in the line of sight of the observer via the reflection in the mirror, the mirror extends along a plane which encloses an acute angle with the central axis of the body to be inclined downwardly toward the observer in the intended position of use of the toy or, generally speaking, the mirror has an axis that encloses an acute spatial angle with the central axis of the body and toward the observer in the upward direction in the intended position of use of the toy. This inclination of the plane of the mirror or of its axis renders it possible for the observer to observe the image of the head or figure, or of the changing background, in the mirror at all times, that is, even as the toy conducts its oscillatory motion.

It is currently preferred for the body to be of a substantially rigid synthetic plastic material, since then the oscillatory motion will last for a long, long time. It is also proposed by the present invention to incorporate a chiming device within the body, this chiming device being operative for producing chiming sounds during and in response to the oscillatory motion of the toy. The production of such sounds by the toy during the motion thereof will give the toy an even more life-like impression in the mind of the child playing therewith.

The novel features which are considered as characteristic of the invention are set forth in particular in the appended claims. The improved rockable toy itself, however, both as to its construction and its mode of operation, together with additional features and advantages thereof, will be best understood upon perusal of the following detailed description of certain specific embodiments with reference to the accompanying drawings.

DETAILED DESCRIPTION OF THE PREFERRED EMBODIMENT

Figure 1:
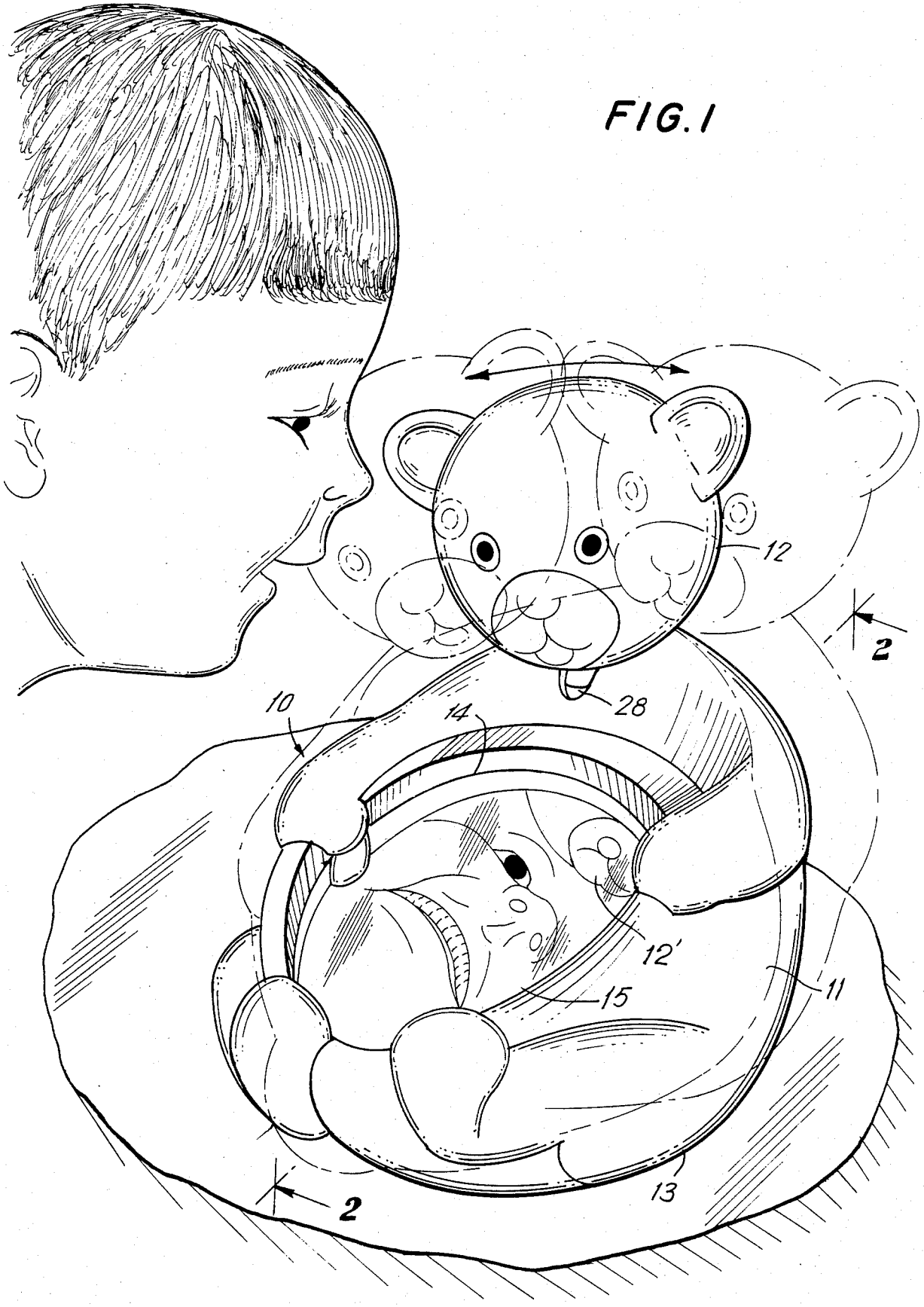
FIG. 1 is is a perspective view of a rockable toy according to the present invention in its position of intended use relative to a child playing with the toy.

Referring now to the drawing in detail, and first to FIG. 1 thereof, it may be seen that the reference numeral 10 has been used therein to identify the toy of the present invention in its entirety. The toy 10 includes, as two of its basic components, a body 11 which has the configuration of a sitting body of a figure in the illustrated embodiment, and an element 12, which is illustrated as having the appearance and distinctive features of an animal head, particularly that of a bear, and thus completes the appearance of the toy into that of a toy animal, that is, of a toy bear. The body 11 is of a substantially rigid material, especially of a substantially rigid synthetic plastic material, and has a bottom surface 13 which is curved in all directions. The center of gravity of the toy 10 is situated relatively low and, in any event, within the region bounded by the bottom surface 13 so that, each time the toy is displaced out of its stable position shown in bold lines in FIG. 1 into any displaced position, such as those indicated in phantom lines in FIG. 1, it will have the tendency to right itself up, that is to return to its original stable position. Now, because the bottom surface 13 is curved or rounded in all directions, for instance, by being substantially spherical, the toy 10 will overshoot the stable position on its return movement from the displaced position toward the stable position, and eventually reach another displaced position in which it will stop and start moving toward the stable position again. Hence, the toy 10 will oscillate or rock around the stable position, this oscillatory motion being gradually damped until the toy 10 comes to a standstill in the stable position. It will be appreciated that the direction and extent of the oscillatory movement will be determined by the forces applied to the toy 10 to displace it out of its stable condition, that is, the direction, magnitude, and duration of such forces.

FIG. 1 also shows that the body 11 bounds a recess or depression 14 in which there is arranged a mirror 15 which is connected to the body 11 for movement therewith, so that the mirror 15 shares in the oscillatory movement of the toy 10. The mirror 15 is so oriented that, in the position illustrated in FIG. 1, the child observing the toy 10 will see a reflection of the head 12 of the toy 10 in the mirror 15 during the entire duration of the oscillatory motion of the toy 10, not to speak about the period during which the toy 10 is at a standstill. Hence, the child will be able to observe the distinctive features of the head 12 of the toy in the mirror 15. Now, as the toy 10 conducts its oscillatory motion, the background behind the reflection of the head 12 in the mirror will rapidly change, thus giving the impression of rapid and extensive motion of the toy 10 relative to the environment. It will be appreciated that the reflection of the environment or backdrop in the mirror 15 behind the reflection of the head 12 will be everchanging during the oscillatory motion of the toy 10.

Figures 2, 3:
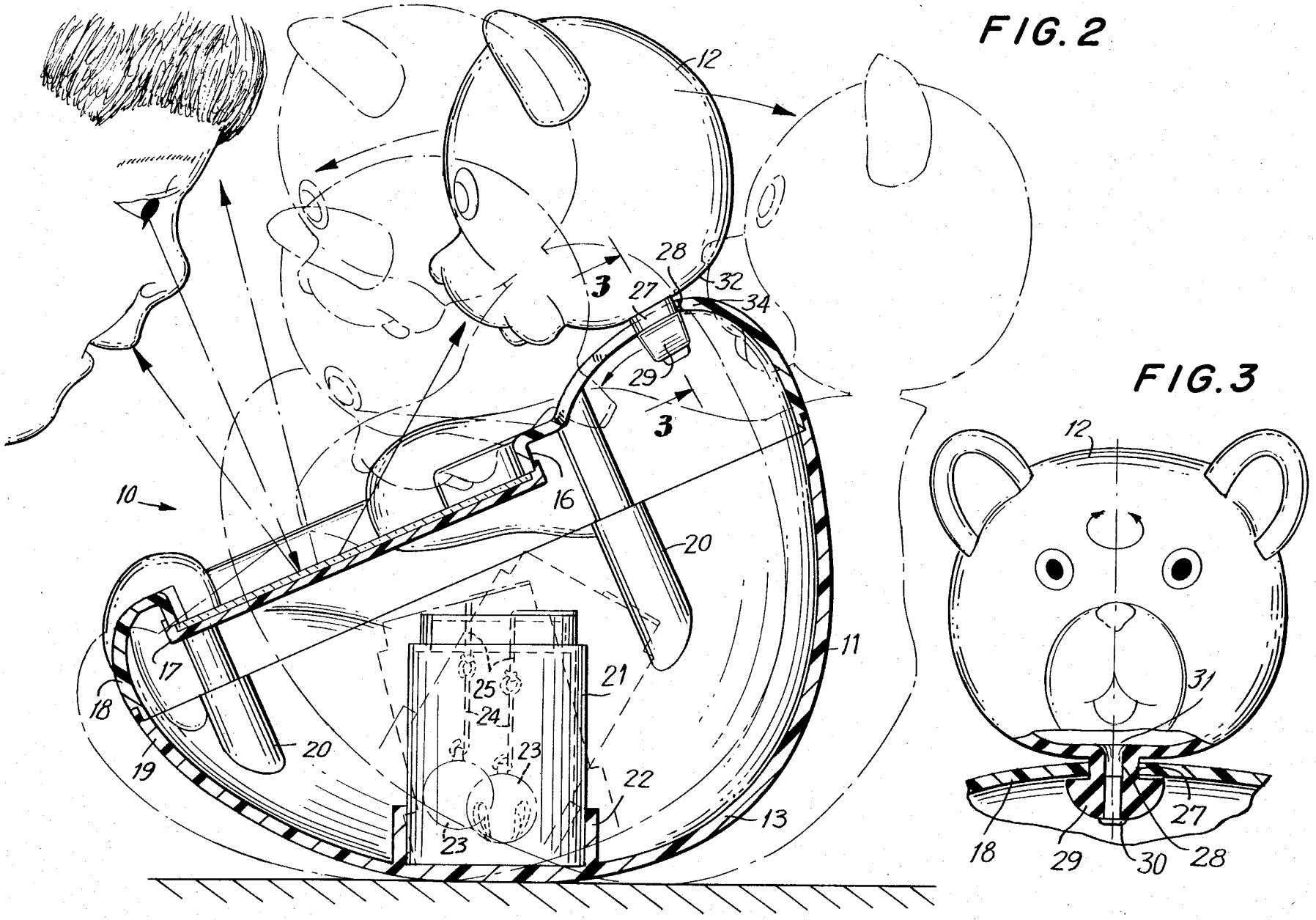
FIG. 2 is a partially cross-sectioned view of the toy taken in a plane 2—2 of FIG. 1.
FIG. 3 is a partly sectioned view of a detail of the toy taken along the line 3—3 of FIG. 2.

As shown in FIG. 2, the mirror 15 is connected to a tubular portion 16 of the body 11. This connection may be constituted by a clamping engagement of an annular rim 17 of the mirror 15 with the tubular portion 16 of the body 11. However, an even better security of the connection is achieved when the mirror 15 is connected to the body 11 and particularly to the tubular portion 16 thereof by a layer of glue.

Advantageously, the body 11 is constituted by two parts, that is, an upper part 18 and a lower part 19 which are connected to one another by means of screws (not shown) accommodated in connecting pillars 20, in a manner well known in the toy-manufacturing field. The parts 18 and 19 are preferably made of a substantially rigid synthetic plastic material, so that the body 11 and particularly the lower part 19 thereof will not be deformed as the toy 10 rocks on the bottom surface 13.

FIG. 2 also shows that a casing 21 is accommodated in the interior of the body 11. The casing is connected to the bottom or lower part 19 by being retained in an annular holding member 22 integrally formed on the bottom part 19, such as being frictionally retained or glued in the same. In the interior of the casing 21, there is accommodated a substantially spherical chiming element 23 which is suspended in the interior of the casing 21 by a pending or flexible element 24 which hangs from a supporting element 25 that is rigid with the casing 21. As the body ll, and with it the casing 21, move, the chiming element conducts differential movement relative to the casing and occasionally hits the inner wall of the casing 21, thus producing chiming sounds. Chiming devices of this kind, such as washers, are well known in the art so that no further explanation of their construction or operation is deemed to be necessary.

It may also be seen in FIG. 2 that the head 12 is provided with a neck portion or pin 27 which is received in a slot 28 of the body 11, and passes therethrough between the exterior and the interior of the body 11. The pin 27 has an enlarged or capturing portion 29 which engages behind the upper portion 18 of the body 11 at the two side walls bounding the slot 28. The slot 28 is elongated in the front-to-rear direction of the toy 10 as considered relative to the observer in the intended position of use of the toy 10 as shown in FIG. 1 or 2. The pin 27 is slidably movable along the length of the slot 28, and is captured in any selected position in the slot by the capturing portion 29. The pin 27 also defines along its length a pivot axis about which the head can be turned in either circumferential direction. Thus, the position of the head 12 relative to the body 11 is adjustable not only forwardly and rearwardly of the slot 12, but also in either circumferential direction about the pivot axis defined by the pin 27. The adjustability of the head 12 to any desired orientation relative to the body 11 permits the head 12 to be positioned relative to the inclined mirror 15 such that the reflection 12' (see FIG. 1) of the head 12 will appear in the mirror to the observer not only in the stable position, but also in any displaced position during the entire oscillatory motion of the toy 10. The angle of inclination of the mirror 15 is on the order of 45° relative to the horizontal support surface on which the toy 10 is supported.

In addition, it is advantageous if the pin 17 and/or the head 12 are flexible and/or if the underside 32 of the head 12 is curved upwardly away from, and/or is spaced away from, the downwardly curved upper side or shoulder portion 34 of the body 11. In such event, the head 12 will conduct a separate movement relative to the body during the movement of the latter, said separate movement being universal, e.g. not only in the front-to-rear and side-to-side directions, but also in any other direction as permitted by the flexibility of the pin and/or the head and by the spacing between and the curvatures of the underside 32 of the head 12 relative to the shoulder portion 34. The capturing portion 29 advantageously relatively loosely captures the head 12 on the body 11 so as to maintain the head in a generally upright condition, but also permitting said separate universal movement. Thus, after the orientation of the head 12 has been adjusted, and as the toy 10 rocks, the head 12 will perform said separate movement, as indicated in phantom lines in FIG. 2.

Referring now to FIG. 3, it may be seen therein that a stub 30 is inserted into an internal passage 31 of the pin 27. This stub 30 accommodates a reed or a similar sound-producing device of a conventional construction which produces sounds as air rushes through the interior of the stub 30. As mentioned before, the head 12 is made of a flexible material, especially a flexible synthetic plastic material, so that the head 12 can be squeezed and deformed by the user of the toy 10, thus causing air to rush in one or the other direction through the stub 30, resulting in the production of the aforementioned sounds. This adds to the enjoyment of the toy by the child. As mentioned above, the sound-producing device incorporated in the stub 30 is of a conventional construction, well known to those active in the toy manufacturing field, so that any further explanation of the construction or function thereof here would be superfluous.

It will be understood that each of the elements described above, or two or more together, may also find useful application in other types of arrangements differing from the type described above.

While the invention has been illustrated and described as embodied in a rockable toy with a reflecting mirror, it is not intended to be limited to the details shown, since various modifications and structural changes may be made without departing from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed as new and desired to be protected by Letters Patent is set forth in the appended claims.

I claim:

1. A rockable toy, comprising a main body having a bottom surface that is curved in all directions, the toy having a center of gravity situated substantially on a central axis of said body and within the confines of said curved bottom surface so that, when the toy is displaced in any direction from its stable position in which said central axis is substantially vertical, it will oscillate about its stable position until such oscillatory motion is damped sufficiently for the toy to remain in its stable position; and at least one mirror mounted on said main body for displacement therewith to present to the observer of the toy different and constantly changing reflected images during the oscillatory motion of the toy, said main body has substantially the configuration of a body of a figure in a sitting position; and further comprising a head mounted on said body outside the periphery of said mirror and in the line of sight of the observer via its reflection in said mirror in the intended position of use of the toy relative to the observer, so that the reflection of the head in the mirror will appear in front of an ever-changing background during the oscillatory motion of the toy.

2. The rockable toy as defined in claim 1, wherein said head is mounted on said body for a swinging motion relative to the latter in at least two opposite directions so that, during the oscillatory motion of the toy, the swinging motion of the reflection of the head in the mirror will be superimposed on the ever-changing background.

3. The rockable toy as defined in claim 2, wherein said head is mounted on said body with freedom of movement relative to said body in a multitude of directions.

4. The rockable toy as defined in claim 1, wherein said head is of an elastic material so as to be capable of being squeezed and deformed.

5. The rockable toy as defined in claim 4, wherein said head includes a squeaking device incorporated therein and operative for producing at least one sound in response to the deformation of the head.

6. The rockable toy as defined in claim 1, wherein said mirror extends along a plane which encloses an acute angle with said central axis of said body to be inclined downwardly toward the observer in the intended position of use of the toy.

7. The rockable toy as defined in claim 1, wherein said mirror has an axis that encloses an acute spatial angle with said central axis of said body and toward the observer in the upward direction in the intended position of use of the toy.

8. The rockable toy as defined in claim 1, wherein said body is of a substantially rigid synthetic plastic material.

9. The rockable toy as defined in claim 1, and further comprising a chiming device within said body and operative for producing chiming sounds during and in response to the oscillatory motion of the toy.

10. The rockable toy as defined in claim 1, wherein said main body has an elongated slot; and further comprising an element of distinctive features forming an extension of said body, and means for adjustably mounting said element in said slot at a region situated outside the periphery of said mirror and in the line of sight of the observer via its reflection in said mirror in the intended position of use of the toy relative to the observer, so that the reflection of the distinctive features of the element in the mirror will appear in front of an ever-changing background during the oscillatory motion of the toy.

11. The rockable toy as defined in claim 10, wherein said mounting means includes an elongated pin which passes through and is movable along said slot, and a capturing portion which engages the interior of said body behind said slot.

12. The rockable toy as defined in claim 11, wherein said pin is constituted of a resilient, flexible material.

13. The rockable toy as defined in claim 1, wherein said mirror is inclined at an angle on the order of 45° relative to a horizontal support surface on which the toy is rockably supported.

14. A rockable toy comprising:

a main body having substantially the configuration of a body of a figure in a sitting position, and a bottom surface that is curved in all directions, the toy having a center of gravity situated substantially on a central axis of said body and within the confines of said curved bottom surface so that, when the toy is displaced in any direction from its stable position in which said central axis is substantially vertical, it will oscillate about its stable position until such oscillatory motion is damped sufficiently for the toy to remain in its stable position;

at least one mirror mounted on said main body for displacement therewith to present to the observer of the toy different and constantly changing reflected images during the oscillatory motion of the toy;

a head having distinctive facial features forming an extension of said body; and means for adjustably mounting said head on said body outside the periphery of said mirror and in the line of sight of the observer via its reflection in said mirror in the intended position of use of the toy relative to the observer, so that the reflection of the head in the mirror will appear in front of an ever-changing background during the oscillatory motion of the toy.

15. The rockable toy as defined in claim 14, wherein said mounting means mounts said head in any one of a multitude of orientations relative to and on said body.

16. The rockable toy as defined in claim 14, wherein said mounting means mounts said head with multiple freedoms of movement relative to and on said body.

* * * * *